United States Patent [19]

Jacobsen et al.

[11] 3,977,325

[45] Aug. 31, 1976

[54] COMBUSTIBLE CARTRIDGE CASINGS AND METHOD FOR MAKING SAME

[75] Inventors: Kjell Ole Jacobsen, Lillestrom; Edvard Tröen, Raufoss, both of Norway

[73] Assignee: A/S Raufoss Ammunisjonsfabrikker, Norway

[22] Filed: May 28, 1974

(Under Rule 47)

[21] Appl. No.: 474,007

[30] Foreign Application Priority Data

May 25, 1973 Norway ..... 2179/73

[52] U.S. Cl. ..... 102/43 R; 86/1 R; 102/DIG. 1

[51] Int. Cl.[2] ..... F42B 5/18; F42B 9/16

[58] Field of Search ..... 102/43 R, 43 P, DIG. 1; 86/1 R

[56] References Cited

UNITED STATES PATENTS

| | | | |
|---|---|---|---|
| 2,564,695 | 8/1951 | Johnson, Jr. et al. | 102/43 P |
| 2,837,456 | 6/1958 | Parilla | 102/43 P |
| 2,982,211 | 5/1961 | Beal et al. | 102/43 R |
| 3,264,993 | 8/1966 | DeFries et al. | 102/43 R |
| 3,293,056 | 12/1966 | Baker | 102/DIG. 1 |
| 3,304,867 | 2/1967 | Nadel | 102/DIG. 1 |
| 3,747,532 | 7/1973 | Berger | 102/43 R |

FOREIGN PATENTS OR APPLICATIONS

| | | | |
|---|---|---|---|
| 412,012 | 6/1934 | United Kingdom | 102/43 R |

*Primary Examiner*—Charles T. Jordan

*Attorney, Agent, or Firm*—Larson, Taylor and Hinds

[57] ABSTRACT

A combustible casing for ammunition having walls mainly of nitrocellulose in the form of nitrated textile. The casing is made by winding a fiber reinforced nitrated textile thread around a mandrel and applying a binding agent to hold the threads together.

7 Claims, 3 Drawing Figures

COMBUSTIBLE CARTRIDGE CASINGS AND METHOD FOR MAKING SAME

The invention relates to combustible cartridge casings for ammunition and a method for making such casings.

For larger calibers combustible casings have the obvious advantages over casings of steel or metal in the saving of large quantities of material that in many cases may become scarce. In addition, return transportation of spent cartridges is avoided, and transportation of the ammunition becomes simpler due to reduced weight as compared to ammunition with casings of steel or metal. The savings in weight also means that a person can carry a larger quantity of ammunition.

It is previously known in principal to make cartridge casings of combustible material. German Pat. No. 1,918,320 describes a method for making combustible casings from nitrated fabric. The method in accordance with said patent consists of guiding the fabric through a bath of dissolved nitrocellulose. Following the bath, the individual layers of fabric are merged to a laminate which is led between press rollers for pressing out the superfluous solvent, drying and cutting. The cut pieces of the laminate are formed into casings and are glued together in overlapping seams. For this gluing it is possible to use a nitrocellulose solution of the same type as used in the bath through which the fabric was guided.

There are several drawbacks associated with this known method and the casings made in accordance with it.

By the known method, it is difficult to perform a controlled adjustment of the porosity of the casing wall. This porosity plays an important part in the combustion of the casings. Too high porosity will give too high a combustion velocity which in turn will give undesireably rapid pressure rise and/or undesireably high maximum pressure during firing. It has been tried to press the casings after the forming, but this has not led to reliable results.

Casings made in accordance with the known method do not possess good strength characteristics and are therefore sensitive to mechanical stress.

Another problem assosiated with the known method is that it is not well suited for production since it requires cutting of the fabric laminate, forming of the casings and gluing the casings together in overlapping seams. This work makes the production poorly suited for industrial mass production.

In the present invention, which will appear from the following patent claims, these drawbacks are generally eliminated. Casings made by the method in accordance with the present invention can be produced in a simple and economical way so that the requirements to correct porosity are satisfied and the casings will represent homogeneous structures with high mechanical strength.

The method is well suited for mass production because the craftsmanlike work is substantially reduced in comparison with the method in accordance with said German patent.

In order that the present invention may more readily be understood the following description is given, merely by way of example, reference being made to the accompanying drawing, in which.

Figure 1:
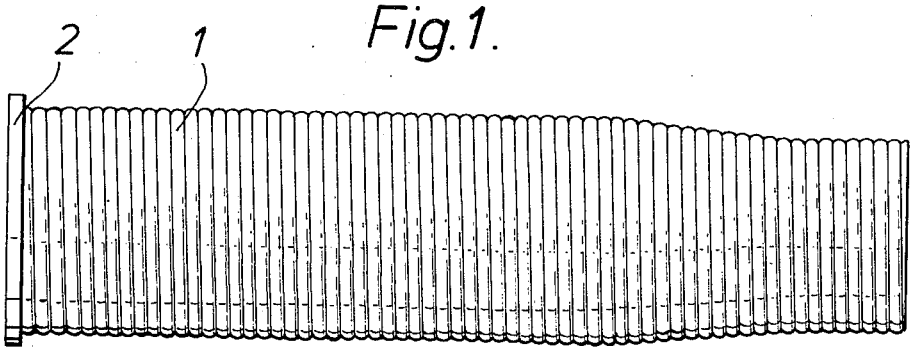
FIG. 1 shows a combustible cartridge casing according to the invention.

The casing of FIG. 1 has a wall 1 consisting of wound thread of combustible material. The base 2 of the casing is also made of a combustible material of a composition similar to that of the thread and is formed from nitrated textile discs which have been cut and pressed to the desired form and attached to the thread windings by means of a suitable adhesive.

Figure 2:
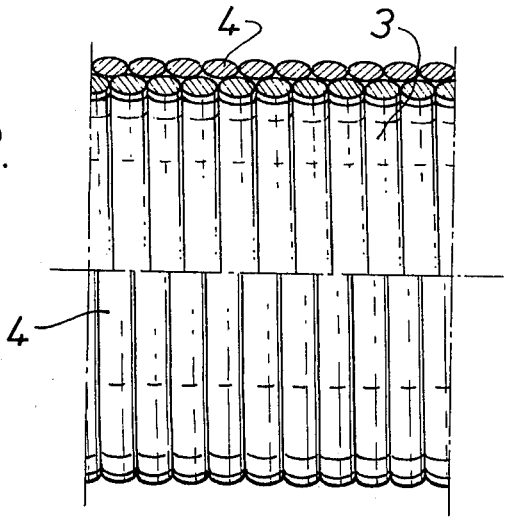
FIG. 2 shows a fraction of a casing according to the invention where the upper half is shown in section.

FIG. 2 shows part of a casing consisting of two layers 3,4 of thread wound in mutually opposite directions. The upper half of FIG. 2, which is in section, shows the inner layer 3 while the lower half shows the outer layer 4.

Figure 3:
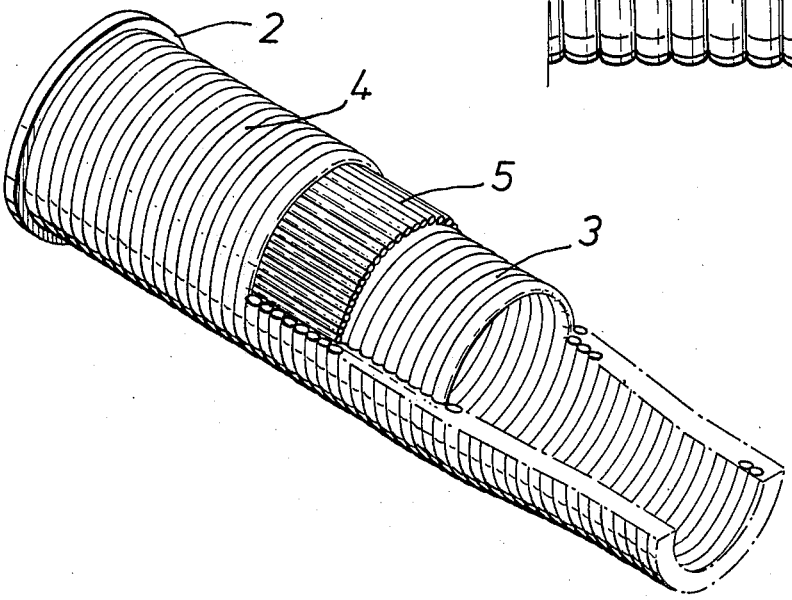
FIG. 3 shows a perspective, partly cut-away view of another casing according to the invention.

The casing of FIG. 3 comprises two wound layers 3,4 of thread and one layer 5 in which the threads extend in the longitudinal direction. The casing also comprises a metal base 2.

The porosity of the finished casings is dependent upon the tension of the thread during the winding and must be kept at a certain level. The suitable tension must of course be found by trial production, whereupon a suitable apparatus can be used in the industrial mass production for maintaining the desired tension.

It has become apparent that non-reinforced textile thread cannot withstand the tensile stress associated with the desired thread tension during the winding process. It is therefore necessary to reinforce the thread. It must be required of the reinforcing material that it will burn without leaving harmful residue in the weapon and that it will give the thread the necessary tensile strength. It has been found that synthetic fiber is a well suited reinforcing material. Types of plastic that are well suited comprise polypropylene, terylene, nylon and other types of plastic with high tensile strength.

There are several possiblities for making fiber reinforced nitrated textile thread for the winding. The thread itself can be produced with fiber reinforcement analagous to fiber reinforced fabrics. Other possibilities are for instance that textile and synthetic fiber are spun together or that the textile thread is made like a sheath that surrounds the fiber reinforcement. These mentioned possibilities do of course not constitute a restriction of the invention since it does not require specific embodiments of the thread. Nor is the cross sectional form of the thread decisive. However, it is natural to use thread of circular cross section, this not being mentioned as a limitation.

The application of the binding agent which is to hold the casing together can be performed in several ways, for instance by leading the thread through a bath of binding agent or by applying the binding agent by spraying or brushing. The application of the binding agent can be performed before, during or after the winding prosess. Application of the binding agent before the winding is supposed to be most advantagous because this insures that the entire surface of the thread is coated with binding agent.

The binding agent can preferably be nitrocellulose which is applied in dissolved condition. It has also been found that plastic is a useable binding agent, for instance polyurethane.

In order to protect the finished casings during transportation and storage, one can employ a protective outer cover of known type consisting for instance of a water impermeable material.

The number of layers of thread will be dependent upon the type of weapon, length of the casing, the requirements for mechanical strength and whether the ammunition is of the fixed or divided type. The winding of several layers can be performed in mutually different directions so that the threads in one layer cross the threads in a layer on its inside or outside. The mechanical strength in such a casing is higher than in one where the windings are all in the same direction.

A special embodiment of the casing in accordance with the invention comprised at least one layer of threads parallel to the longitudinal direction of the casing walls in addition to the wound layers of thread. This accomplishes a substantial stiffening of the casings.

The casings can be fitted with a metal base. It is also possible to make the base from combustible material and to use an igniting device which will undergo complete combustion by the ignition. Thus, there will be nothing left to be pulled out of the weapon before reloading can take place. This has obvious advantages with respect to the construction of the weapon, its functioning reliability, firing speed and other factors of substantial importance that shall not be detailed any further here.

It is not implied here that the combustible casings in accordance with the invention will give much of the total driving energy developed by the combustion. It is assumed that the casings are filled with powder just like casings of steel or metal. The combustible casing material can usually be assumed to replace an equivalent amount of powder and, in practice, this means that the amount of powder can be reduced by about 10–20 % as compared to casings of steel or metal.

What is claimed is:

1. A combustible casing for ammunition having walls comprised substantially of nitrocellulose in the form of nitrated textile, wherein said walls contain at least two wound layers of fiber reinforced nitrated textile thread with at least one of said layers of thread running substantially parallel to the longitudinal axis of the casing and wherein said wound thread is bonded together by a bonding agent.

2. A combustible casing for ammunition of claim 1 wherein said thread is reinforced by synthetic fibers.

3. A combustible casing in accordance with claim 1, characterized in that at least two layers are wound so that the threads of the layers cross each other.

4. A combustible casing in accordance with claim 3, characterized in that at least two layers of thread are wound with mutually opposite pitch direction.

5. A method of making combustible cartridge casings comprising nitrocellulose, said method comprising the steps of:

winding at least three layers of a synthetic fiber-reinforced nitrated textile thread on a mandrel;

winding at least one of the layers of said thread which forms neither the adjacent layer to said mandrel nor the outer layer of said casing in the longitudinal direction;

maintaining tension on said thread during said winding; and applying a binding agent to the thread to hold the wound thread in the shape of the casing.

6. A method according to claim 5 further comprising the step of applying a protective outer covering to the thread to protect the casing.

7. A method according to claim 5 wherein said bonding agent is applied to the thread prior to the thread being wound on the mandrel.

* * * * *